US011772761B2

(12) United States Patent
Shen et al.

(10) Patent No.: US 11,772,761 B2
(45) Date of Patent: Oct. 3, 2023

(54) UNDERWATER VEHICLE WITH FRONT-REAR DISTRIBUTED DRIVE

(71) Applicant: City University of Hong Kong, Hong Kong (CN)

(72) Inventors: Yajing Shen, Hong Kong (CN); Jiahai Shi, Hong Kong (CN); Panbing Wang, Hong Kong (CN); Xiong Yang, Hong Kong (CN)

(73) Assignee: City University of Hong Kong, Hong Kong (CN)

( * ) Notice: Subject to any disclaimer, the term of this patent is extended or adjusted under 35 U.S.C. 154(b) by 204 days.

(21) Appl. No.: 17/448,533

(22) Filed: Sep. 23, 2021

(65) Prior Publication Data

US 2023/0088089 A1 Mar. 23, 2023

(51) Int. Cl.

| | |
|---|---|
| ***B63G 8/08*** | (2006.01) |
| ***B63G 8/16*** | (2006.01) |
| ***B63G 8/00*** | (2006.01) |

(52) U.S. Cl.

CPC ..... *B63G 8/08* (2013.01); *B63G 8/001* (2013.01); *B63G 8/16* (2013.01); *B63G 2008/004* (2013.01); *B63G 2008/005* (2013.01)

(58) Field of Classification Search

CPC ..... B63G 8/16; B63G 2008/004; B63G 8/20; B63H 1/36

See application file for complete search history.

(56) References Cited

U.S. PATENT DOCUMENTS

2018/0021945 A1* 1/2018 Pettersen ..... B25J 9/065 700/245

FOREIGN PATENT DOCUMENTS

CN 113232807 A * 8/2021 ..... B63C 11/52
DE 102012206843 A1 * 10/2013 ..... B63H 1/36

OTHER PUBLICATIONS

Huang, Chaolei, et al. "Miniaturized swimming soft robot with complex movement actuated and controlled by remote light signals." Scientific reports 5 (2015): 17414.

Katzschmann, Robert K., et al. "Exploration of underwater life with an acoustically controlled soft robotic fish." Science Robotics 3.16 (2018): eaar3449.

Shen, Zhong, Junhan Na, and Zheng Wang. "A biomimetic underwater soft robot inspired by cephalopod mollusc." IEEE Robotics and Automation Letters 2.4 (2017): 2217-2223.

(Continued)

*Primary Examiner* — Andrew Polay

(74) *Attorney, Agent, or Firm* — S&F/WEHRW

(57) ABSTRACT

An underwater vehicle for performing a variety of linear motions and turning motions with better stability and agility is disclosed. The underwater vehicle includes a main body, a front-drive mechanism, a rear-drive mechanism, and a steering assembly. The main body has a front end and a rear end, which defines a longitudinal axis extending from the front end to the rear end of the main body. The front-drive mechanism is connected to the main body to provide a forward propelling force in a direction parallel to the longitudinal axis. The steering assembly is fixed to the rear end and coupled to the rear-drive mechanism. The steering assembly is configured to rotate the rear-drive mechanism with respect to the longitudinal axis by a body angle for providing a lateral force on the main body.

20 Claims, 7 Drawing Sheets

(56) References Cited

OTHER PUBLICATIONS

Triantafyllou, Michael S., and George S. Triantafyllou. "An efficient swimming machine." Scientific american 272.3 (1995): 64-70.
Cortez, Ricardo. "The method of regularized Stokeslets." SIAM Journal on Scientific Computing 23.4 (2001): 1204-1225.

* cited by examiner

UNDERWATER VEHICLE WITH FRONT-REAR DISTRIBUTED DRIVE

FIELD OF THE INVENTION

The present disclosure generally relates to the field of bionic underwater robot, and particularly relates to an underwater vehicle with a front-rear distributed drive for performing a variety of linear motions and turning motions with better stability and agility.

BACKGROUND OF THE INVENTION

In the field of underwater vehicles, movable underwater vehicles have been widely used to access a liquid environment with complex and/or dangerous conditions, such as the operations in the deep sea. By configuring the underwater vehicles for conducting various tasks inside the liquid environment remotely or autonomously, complex underwater operations such as ocean exploration and underwater detection become realizable. The respective development of movable underwater vehicles has been the ongoing research trend and focus. At present, there are a few unmanned underwater vehicles (UUV) proposed, however, it is difficult for them to achieve high stability and agility.

The UUV may mimic the natural movements of a variety of marine life, for example, dolphins, snakes, sharks, tuna, etc. In particular, some researchers designed a fish-like bionic robot as an underwater vehicle [1]-[4], the propulsion of the conventional fish-like robot is from the beating motion of the tail, which brings the swing motion of the body. Furthermore, the turning motion is only realized by the shape and position of the tail and the fin, which is very complicated to control. In a diverse water flow environment, the conventional UUV may have difficulties in moving against the water motions. Therefore, the conventional approach of being propelled by fin and tail cannot maintain a stable and smooth movement.

Other traditional UUV, such as torpedos, may have a unidirectional propelling system enabling the UUV to move forward quickly, but the turning ability is generally less than satisfactory. The movement direction may be limited to be within a small angle or in accordance with a particular manner.

Accordingly, there is a need in the art to have an improved underwater vehicle with high stability and agility for achieving both stable linear motion and flexibility while easily controlled turning motion. Furthermore, other desirable features and characteristics will become apparent from the subsequent detailed description and the appended claims, taken in conjunction with the accompanying drawings and this background of the disclosure.

SUMMARY OF THE INVENTION

Provided herein is an underwater vehicle. It is an objective of the present disclosure to provide an underwater vehicle that can achieve a variety of motions with better stability and agility for performing a variety of linear motions and turning motions, even in a diverse water flow environment.

In accordance with the first embodiment of the present disclosure, the underwater vehicle includes a main body, a front-drive mechanism, a rear-drive mechanism, and a steering assembly. The main body has a front end and a rear end, which defines a longitudinal axis extending from the front end to the rear end of the main body. The front-drive mechanism is connected to the main body to provide a forward propelling force in a direction parallel to the longitudinal axis. The steering assembly is fixed to the rear end and coupled to the rear-drive mechanism. The steering assembly is configured to rotate the rear-drive mechanism with respect to the longitudinal axis by a body angle for providing a lateral force on the main body.

In accordance with a further aspect of the present disclosure, the front-drive mechanism comprises a plurality of front motors connected to the periphery of the main body.

In accordance with a further aspect of the present disclosure, the plurality of front motors are arranged symmetrically with respect to the longitudinal axis. Preferably, the front-drive mechanism comprises four front motors arranged symmetrically with respect to the longitudinal axis.

In accordance with a further aspect of the present disclosure, the steering assembly comprises a steering engine and a steering arm, wherein the steering arm is pivotable by the steering engine to rotate relative to the longitudinal axis by the body angle.

In accordance with a further aspect of the present disclosure, the steering engine is a servo motor, a stepper motor, or an electromechanical device, such that the body angle is accurately controlled.

In accordance with a further aspect of the present disclosure, the rear-drive mechanism is fixedly connected to the steering arm, thereby the rear-drive mechanism provides the lateral force derived according to a motion direction.

In accordance with a further aspect of the present disclosure, the rear-drive mechanism comprises one or more rear motors arranged to propel along a tail direction defined by the body angle. Preferably, the rear-drive mechanism comprises two rear motors arranged symmetrically with respect to the steering arm.

In accordance with a further aspect of the present disclosure, the steering arm is attached to a cuspate fin structure, wherein the cuspate fin structure is a bionic fishtail for balancing and steering the one or more rear motors to propel along the tail direction.

In accordance with a further aspect of the present disclosure, the underwater vehicle further includes a processor configured to dynamically adjust the forward propelling force, the lateral force, and the body angle for performing a variety of linear motions and turning motions.

In accordance with a further aspect of the present disclosure, the processor is configured to adjust the forward propelling force, the lateral force, and the body angle based on a regularized stokeslet model.

In accordance with a further aspect of the present disclosure, the underwater vehicle is an autonomous underwater vehicle or a remotely operated vehicle.

In accordance with a further aspect of the present disclosure, the front end comprises a half-spherical shell, and the main body is a hollow cylinder.

In accordance with the second embodiment of the present disclosure, a torpedo comprises a main body, a processor housed within the main body, a front-drive mechanism, a rear-drive mechanism, a steering assembly, and a navigation guidance system. The main body has a front end and a rear end, which defines a longitudinal axis extending from the front end to the rear end of the main body. The front-drive mechanism is connected to the main body to provide a forward propelling force in a direction parallel to the longitudinal axis. The steering assembly is fixed to the rear end and coupled to the rear-drive mechanism. The navigation guidance system is configured to communicate with and receive signals from object sensors, satellite communication terminals, or both the object sensors and the satellite communication terminals. The steering assembly is configured to rotate the rear-drive mechanism with respect to the longitudinal axis by a body angle for providing a lateral force on the main body.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Other aspects and advantages of the present invention are disclosed as illustrated by the embodiments hereinafter.

BRIEF DESCRIPTION OF THE DRAWINGS

The appended drawings contain figures to further illustrate and clarify the above and other aspects, advantages, and features of the present disclosure. It will be appreciated that these drawings depict only certain embodiments of the present disclosure and are not intended to limit its scope. It will also be appreciated that these drawings are illustrated for simplicity and clarity and have not necessarily been depicted to scale. The present disclosure will now be described and explained with additional specificity and detail through the use of the accompanying drawings in which.

DETAILED DESCRIPTION OF THE INVENTION

The following detailed description is merely exemplary in nature and is not intended to limit the disclosure or its application and/or uses. It should be appreciated that a vast number of variations exist. The detailed description will enable those of ordinary skilled in the art to implement an exemplary embodiment of the present disclosure without undue experimentation, and it is understood that various changes or modifications may be made in the function and structure described in the exemplary embodiment without departing from the scope of the present disclosure as set forth in the appended claims.

The benefits, advantages, solutions to problems, and any element(s) that may cause any benefit, advantage, or solution to occur or become more pronounced are not to be construed as a critical, required, or essential features or elements of any or all of the claims. The invention is defined solely by the appended claims including any amendments made during the pendency of this application and all equivalents of those claims as issued.

Terms such as "inner", "outer", "front", "rear", "left", "right", and any variations thereof are used for ease of description to explain the positioning of an element, or the positioning of one element relative to another element, and are not intended to be limiting to a specific orientation or position. Terms such as "first", "second", and the like are used herein to describe various elements, components, regions, sections, etc., and are not intended to be limiting.

The present disclosure generally relates to the structure of an underwater vehicle. More specifically, but without limitation, the present disclosure provides an underwater vehicle with a front-rear distributed drive for performing a variety of linear motions and turning motions with better stability and agility.

As used herein, the term "unmanned underwater vehicle (UUV)" is used to describe any vehicle that is operable underwater without a human occupant. For example, the UUV may be an autonomous underwater vehicle (AUV) or a remotely operated vehicle (ROV). Although the preferred embodiment of the present disclosure is applied to a UUV, it is apparent that the description is also applicable to other underwater vehicles, manned or unmanned, without departing from the scope and spirit of the present disclosure.

Figure 1:
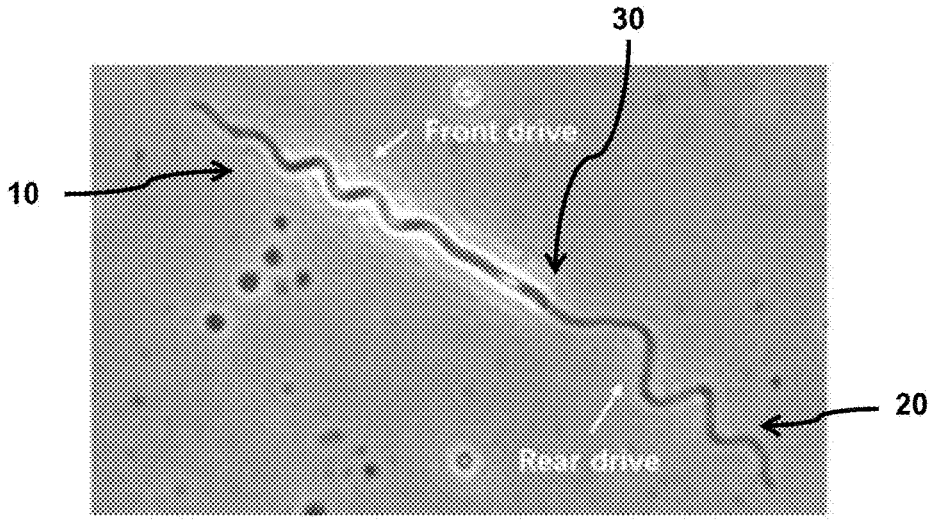
FIG. 1 shows the structure of a ray sperm.

The underwater vehicle of the present disclosure is inspired by the structure and motion of ray sperms. It is generally believed that the movement of sperm is realized by tapping or rotating its soft tail. However, the present disclosure is based on the discovery that the sperm of a ray is particularly different from others. The ray sperms rely on the simultaneous rotation of the tail and head to move. As shown in FIG. 1, the ray sperm consists of two helical sections, namely the spiral head 10 and the soft tail 20, which are connected by the midpiece 30. This kind of structure provides the ray sperm with strong motion stability, namely, linearity and straightness. Both measurements are obviously higher than sperms from other species. The amplitude and frequency of the swing motion are also reduced significantly. In addition, the ray sperm can realize the efficient turning motion in a simple manner, namely the angle change between the spiral head 10 and the soft tail 20. This can lead to a lateral force on the sperm's body, resulting in a turning motion. This peculiar motion style as observed naturally from a ray sperm is the underlining concept for developing the novel underwater vehicle with front-rear distributed drive for performing a variety of linear motions and turning motions with better stability and agility.

Figure 2:
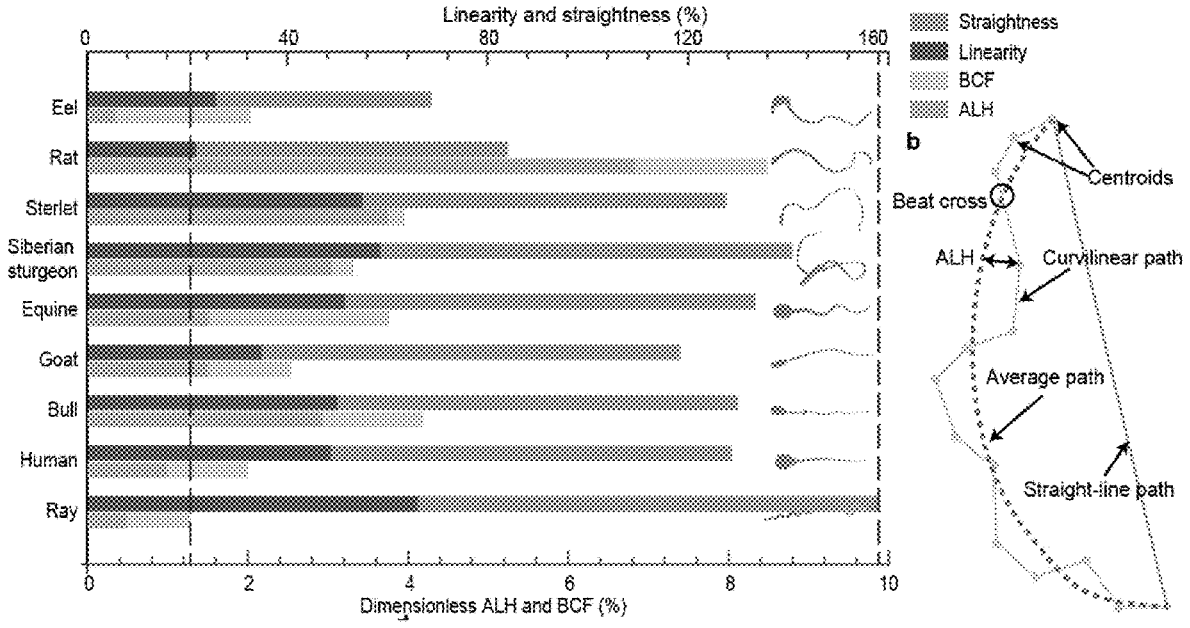
FIG. 2 shows the motion straightness, linearity, beat cross frequency, and amplitude of lateral head displacement of ray sperm comparing with other species.

According to the statistical results of the semen analysis, the motion stability and the linearity of the ray sperms are obviously higher than the sperms from other species, as shown in FIG. 2. The motion linearity, the straightness, the beat cross frequency (swing frequency), and the amplitude of lateral head displacement (ALH) of different species of sperm are compared in the graph. It is clear that the upper bars for straightness and linearity of the ray sperm are longest, which means the motion linearity is superior. Furthermore, the lower bars for the beat cross frequency and ALH of the ray sperm are shortest, which means the motion of the ray sperm is more stable with less swing motion. Being inspired by this comparison, the underwater vehicle is designed to mimic the ray sperm to achieve superior motion stability and linearity.

One general object of this invention is to provide an underwater vehicle that can be used to carry any load and equipment and may have different sizes and lengths. Therefore, various operations and tasks in water can be performed autonomously, partially autonomously, or non-autonomously. More specifically, the present invention is implemented as a UUV.

Another object of this invention is to revolutionize the design of other submersible devices, such as torpedoes and submarines. In certain embodiments, the invention is applied to a guided torpedo, which may be a sonically guided or laser-guided torpedo.

Another object of this invention is to provide a miniature device that can be used for performing biomedical tasks including drug delivery.

Figure 3:
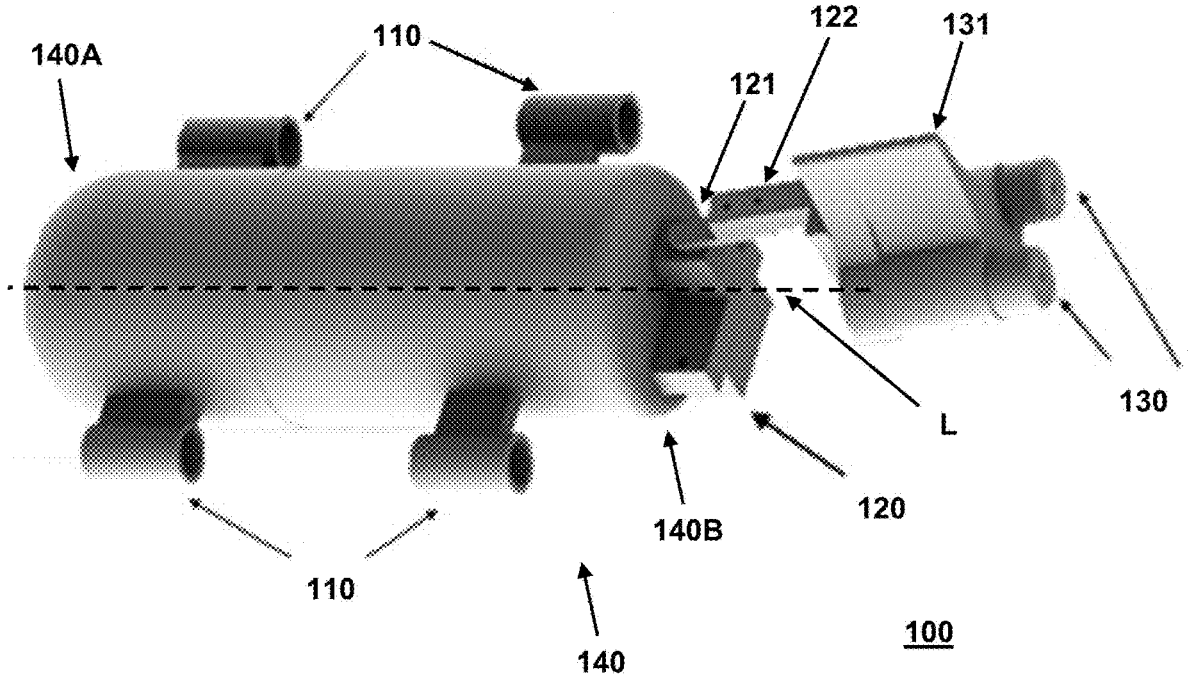
FIG. 3 shows a perspective view of the underwater vehicle with front-rear distributed drive in accordance with certain embodiments of the present disclosure.
Figure 4:
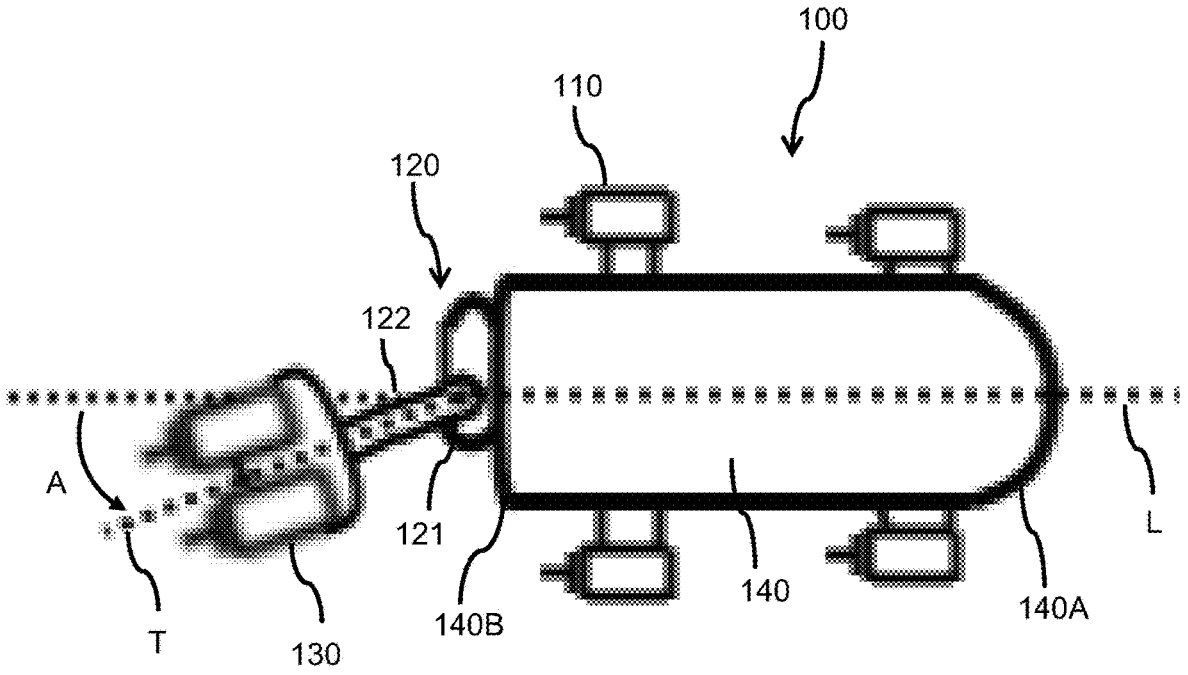
FIG. 4 shows a top view of the underwater vehicle of FIG. 3.
Figure 5A:
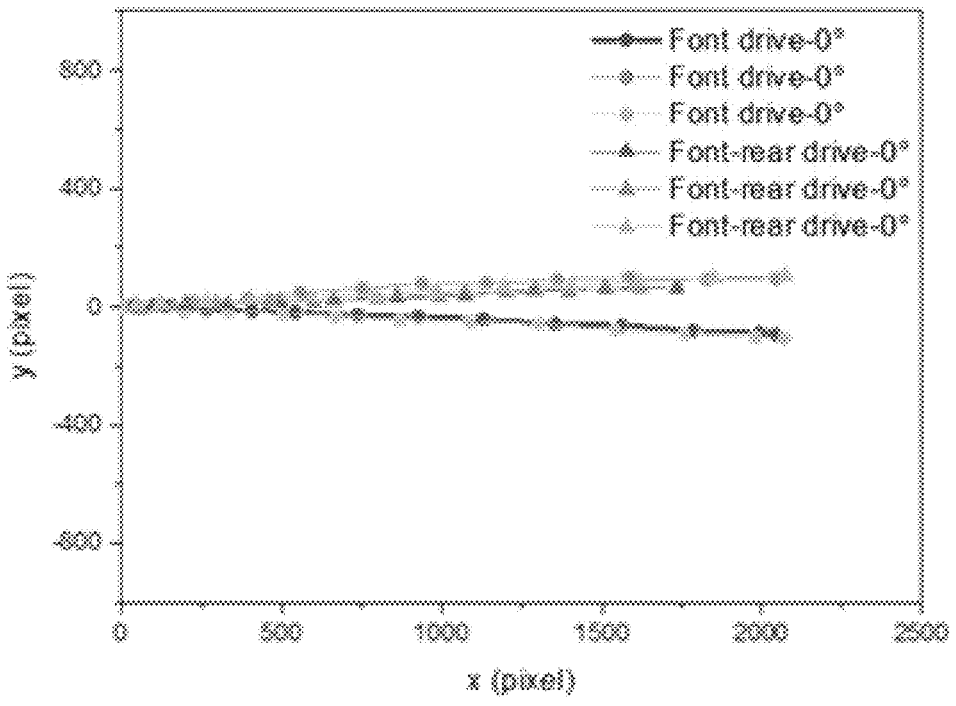
FIG. 5A shows the turning radius of the underwater vehicle of FIG. 3 by front-drive and front-rear drive with 0 degree body angle.
Figure 5B:
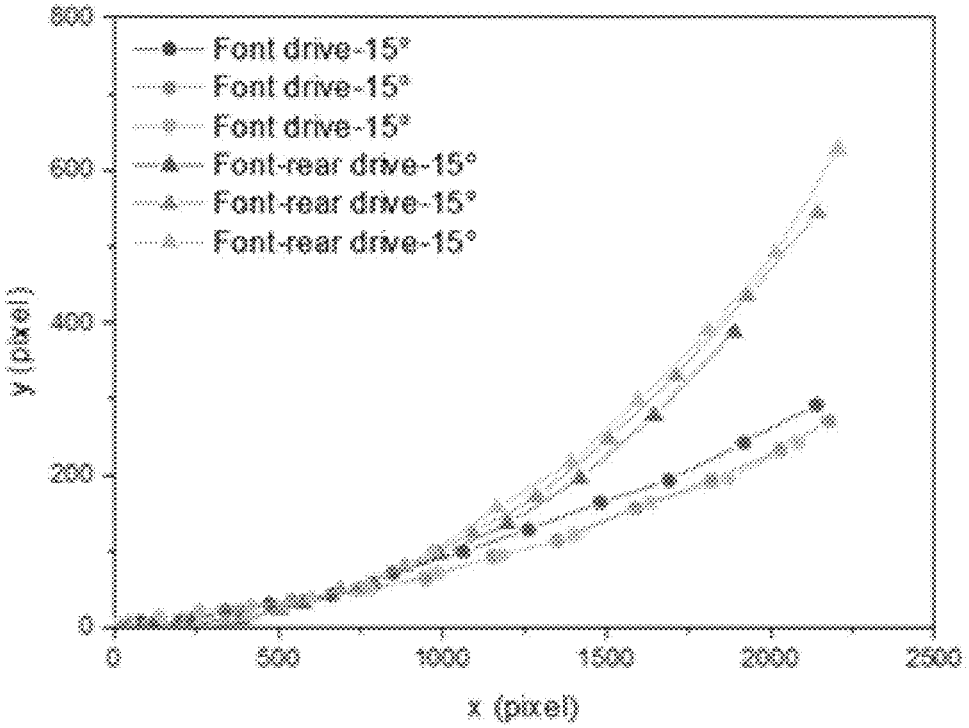
FIG. 5B shows the turning radius of the underwater vehicle of FIG. 3 by front-drive and front-rear drive with 15 degrees body angle.
Figure 5C:
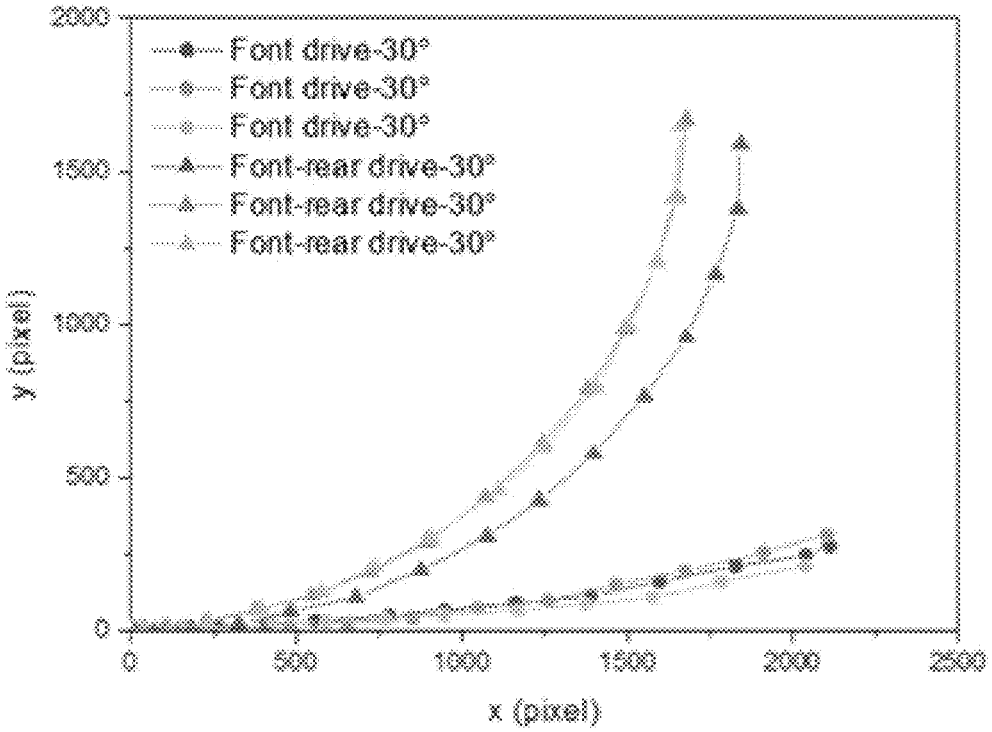
FIG. 5C shows the turning radius of the underwater vehicle of FIG. 3 by front-drive and front-rear drive with 30 degrees body angle.
Figure 5D:
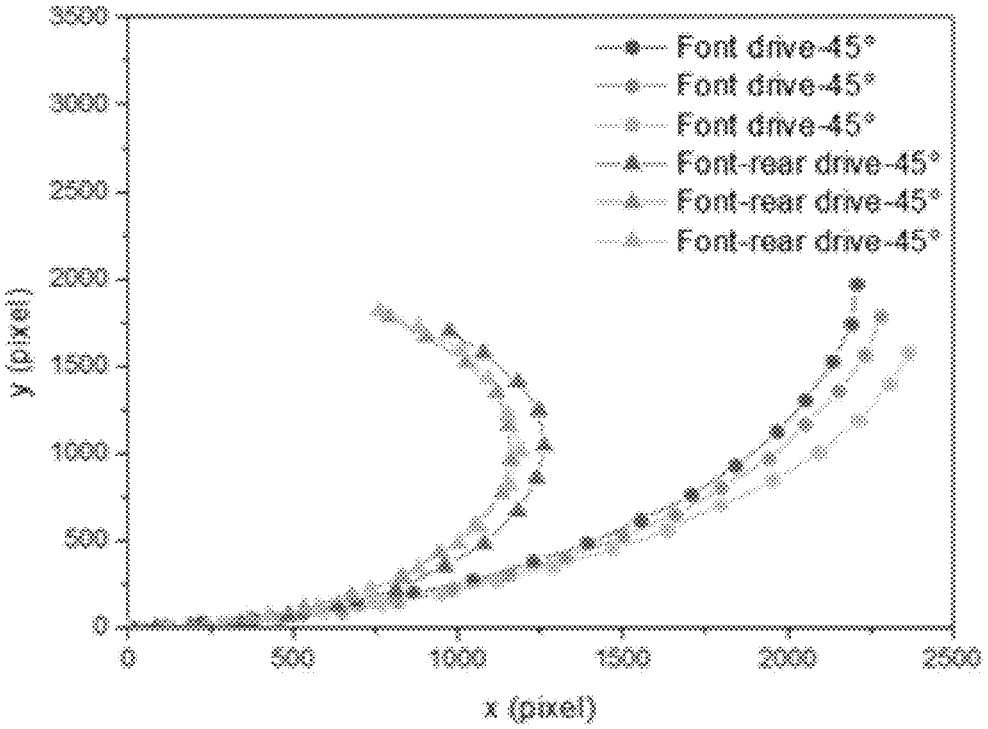
FIG. 5D shows the turning radius of the underwater vehicle of FIG. 3 by front-drive and front-rear drive with 45 degrees body angle.
Figure 5E:
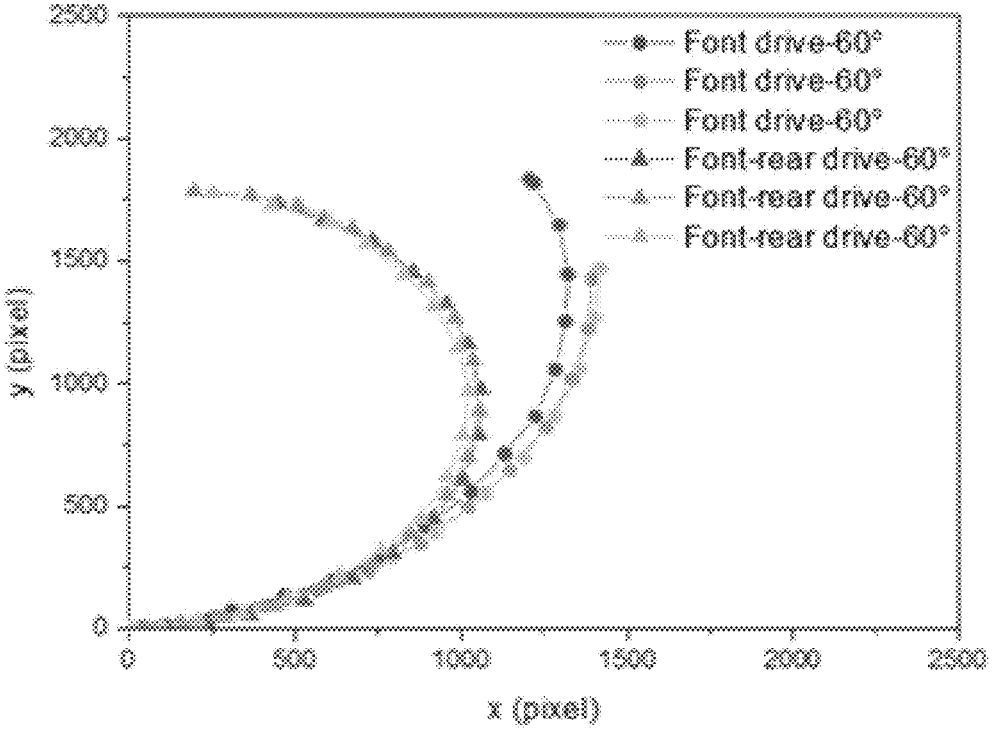
FIG. 5E shows the turning radius of the underwater vehicle of FIG. 3 by front-drive and front-rear drive with 60 degrees body angle.

With reference to FIG. 3 and FIG. 4, there is provided an underwater vehicle 100 structured to mimic a ray sperm. The underwater vehicle 100 with front-rear distributed drive comprises a main body 140, a front-drive mechanism 110, a rear-drive mechanism 130, and a steering assembly 120. The main body 140 has a front end 140A and a rear end 140B. The front end 140A preferably comprises a half-spherical shell, but it is apparent that the front end 140A may also be formed as a flat end, or in the shape of a cone, a pyramid, a frustum, or the like. The front end 140A may also comprise object sensors for identifying any obstacles or objects in front of the underwater vehicle 100. The main body 140 is preferably provided with a shape of a hollow cylinder, and it is apparent that the main body 140 may be in the shape of an elliptical cylinder, a cuboid, a cube, or any combinations thereof without departing from the scope and spirit of the present disclosure. The main body 140 is hollow for providing an internal cavity and may comprise a support structure internally. The internal cavity is provided to house electronic components for controlling the underwater vehicle 100 and performing other customized underwater operations, such as autonomous navigation, ocean exploration, and underwater detection. In certain embodiments, the underwater vehicle 100 with autonomous control (e.g. AUV, torpedo) may include a navigation guidance system and a processor housed within the main body 140. The navigation guidance system is configured to communicate with and receive signals from object sensors, satellite communication terminals, or both the object sensors and the satellite communication terminals for controlling the movement of the underwater vehicle 100. The processor is configured to control the underwater vehicle 100 in response to the navigation guidance system for performing a variety of linear motions and turning motions.

The main body 140 defines a longitudinal axis L extending from the front end 140A to the rear end 140B of the main body 140. The longitudinal axis L is generally parallel to the sidewalls of the main body 140 and substantially the same as the forward propelling direction (without turning) of the underwater vehicle 100.

The front-drive mechanism 110 is connected to the main body 140 to provide a forward propelling force in a direction parallel to the longitudinal axis L. The front-drive mechanism 110 comprises a plurality of front motors connected to the periphery of the main body 140. Preferably, there are four front motors arranged symmetrically with respect to the longitudinal axis L. The front motors are electric motors that drive propellers to rotate with a front motor rotational speed. As shown in the illustrated embodiments, two front motors are attached to a first side of the main body 140, and another two front motors are attached to a second side of the main body 140. As the four front motors are arranged symmetrically with respect to the longitudinal axis L, a balanced force can be applied to the main body 140. Therefore, the main body 140 can be propelled by the front-drive mechanism 110 forward to perform a stable linear motion. It is also apparent that the number of front motors may be otherwise, for example, the front-drive mechanism 110 may include 2, 4, 6, or more front motors without departing from the scope and spirit of the present disclosure. In certain embodiments, the underwater vehicle 100 may include auxiliary motors other than the plurality of front motors, which are also connected to the periphery of the main body 140.

The rear end 140B of the main body 140 may be a flat end, as illustrated. The steering assembly 120 is fixed to the rear end 140B, which may be affixed or otherwise welded to the rear end 140B. In certain embodiments, the steering assembly 120 is formed integrally with the rear end 140B. the steering assembly 120 is configured to rotate the rear-drive mechanism 130 with respect to the longitudinal axis L by a body angle A for providing a lateral force on the main body 140.

The steering assembly 120 comprises a steering engine 121 and a steering arm 122. The steering arm 122 is pivotable by the steering engine 121 to rotate relative to the longitudinal axis L by the body angle A. The rear-drive mechanism 130 is moveable to more than one position as the steering arm 122 rotates. Particularly, in a first position, the steering arm 122 is rotated to substantially in parallel and aligned with the longitudinal axis L to form a straight line, which is the same as the forward propelling direction. In a second position, the steering arm 122 is rotated clockwise by the body angle A relative to the longitudinal axis L such that the steering arm 122 is on the left side of the main body 140 for providing a lateral force toward the right side. In a third position, the steering arm 122 is rotated counter-clockwise by the body angle A relative to the longitudinal axis L such that the steering arm 122 is on the right side of the main body 140 for providing a lateral force toward the left side.

In certain embodiments, the steering engine 121 is a servo motor, a stepper motor, or an electromechanical device, such that the body angle A is accurately controlled. The output shaft of the steering engine 121 is connected to the steering arm 122. For simplicity and clarity, any necessary bearings, gears, pulleys, seals, and/or connectors are not shown in the illustrated embodiment. The steering engine 121 is controlled by the processor to rotate the steering arm 122 mechanically with high precision.

The rear-drive mechanism 130 is fixedly connected to the steering arm 122, which may be affixed or otherwise welded thereto. In particular, the rear-drive mechanism 130 operates to provide a propelling force along a tail direction T, which is substantially aligned with the steering arm 122 as defined by the body angle A and precisely controlled by the steering engine 121. The rear-drive mechanism 130 can provide a lateral force derived according to a motion direction determined by the processor. Preferably, the rear-drive mechanism 130 comprises one or more rear motors arranged to propel along the tail direction T defined by the body angle A. The one or more rear motors are electric motors that drive propellers to rotate with a rear motor rotational speed. The structure of the rear motor may be the same with or different from the structure of the front motor.

As shown in the illustrated embodiments, the rear-drive mechanism 130 comprises two rear motors arranged symmetrically with respect to the steering arm 122 to propel along the tail direction T. Between the two rear motors, there is provided a cuspate fin structure 131 protruded upwardly from the surface of the steering arm 122 to mimic a fishtail. Although the cuspate fin structure 131 is provided above the rear-drive mechanism 130, it is apparent that the cuspate fin structure 131 may also be protruded downwardly or rearwardly relative to the steering arm 122 without departing from the scope and spirit of the present disclosure. The cuspate fin structure 131 acts as a bionic fishtail for balancing and steering the one or more rear motors to propel along the tail direction T.

The processor provided in the main body 140 is configured to control the front-drive mechanism 110, the rear-drive mechanism 130, and the steering assembly 120 according to the intended motion direction. The front-drive mechanism 110 and the rear-drive mechanism 130 operate cooperatively to function as a front-rear distributed drive system for performing a variety of linear motions and turning motions with better stability and agility. Particularly, the processor is configured to dynamically adjust the forward propelling force, the lateral force, and the body angle A for performing a variety of linear motions and turning motions. The forward propelling force is adjusted by changing the front motor rotational speed of the plurality of front motors. The lateral force is adjusted by changing the rear motor rotational speed of the one or more rear motors, based on the body angle A dynamically set accordingly.

To confirm the flexible turning ability of the underwater vehicle 100 with front-rear distributed drive, the turning radius of the underwater vehicle 100 (front-rear drive) is compared with that having only the front-drive mechanism 110 (front-drive) activated. For the front-rear drive, the underwater vehicle 100 is propelled by two front motors and two rear motors. For the case of front-drive, the rear motors are disabled and the underwater vehicle 100 is propelled by four front motors. Hence, the drive power of the above two configurations is the same. The trajectories are captured by a camcorder and the data are presented in FIGS. 5A-5E, which provide the comparison showing the turning radius of the underwater vehicle 100 with a body angle A of 0°, 15°, 30°, 45°, 60°, respectively. According to the experimental results, the underwater vehicles 100 can both move forward with the body angle of 0°. When the body angle A increases, the underwater vehicles 100 can both turn around. Advantageously, the turning radius of the underwater vehicle 100 with front-rear distributed drive is obviously smaller than that with the front-drive. Hence, the underwater vehicle 100 with a front-rear distributed drive has a higher turning flexibility and better agility.

Figure 6A:
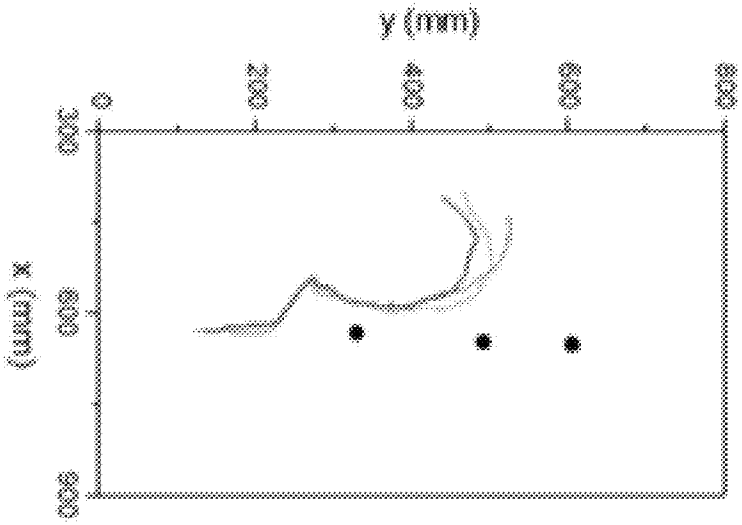
FIG. 6A shows the trajectories of the underwater vehicle of FIG. 3 with front-drive when passing through three markers.
Figure 6B:
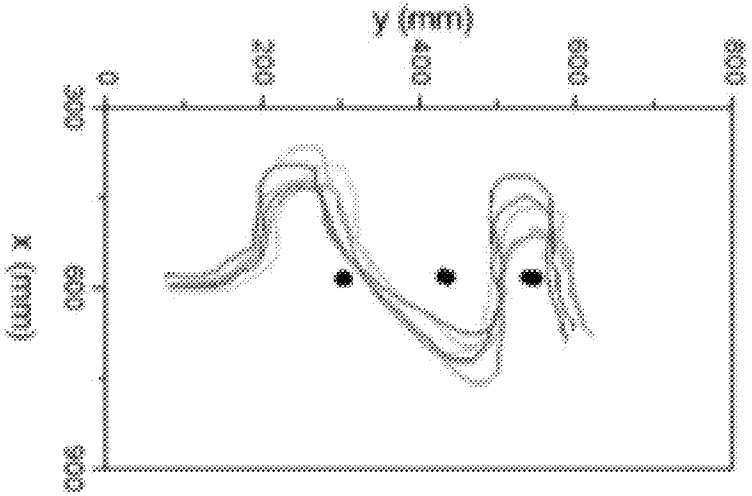
FIG. 6B shows the trajectories of the underwater vehicle of FIG. 3 with front-rear drive when passing through three markers.

To further demonstrate the turning ability of the underwater vehicle 100 with the front-rear distributed drive, the underwater vehicle 100 is tested in a pool of water, and a set of three plastic spheres is placed in the pool as markers. The radius of the sphere is 54 mm and the distance between the center of the neighboring two spheres is 20 cm. The configurations of front-rear drive and front-drive are the same as above. The same program for controlling the movement of the underwater vehicle 100 to move in an S-trajectory is used. The recorded trajectories are shown in FIGS. 6A-6B. The underwater vehicle 100 should move in an S-trajectory to pass through those markers, however, the underwater vehicle 100 with front-drive failed to make a turn sharp enough because its turning radius is not small enough. Only the underwater vehicle 100 with front-rear distributed drive can pass through the markers smoothly.

Figure 7:
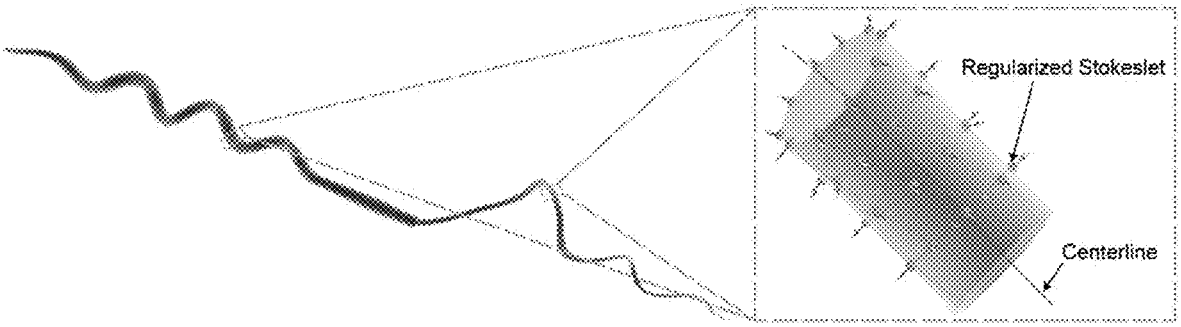
FIG. 7 shows a model of the ray sperm propelled by dual helixes based on the regularized stokeslet method.

To finely control the movement of the underwater vehicle 100 with front-rear distributed drive, the processor is configured to adjust the forward propelling force, the lateral force, and the body angle A based on a regularized stokeslet model. The rear-drive mechanism 130 and the steering assembly 120 function similarly as a segment of the ray sperm, as provided in FIG. 7. According to this method, the relationship between the velocity and the force acting on a segment is:

$$v_i(x) = \frac{1}{8\pi\mu} S_{ij}^{\varepsilon}(x, x_0) g_j \quad \text{(Equation 1)}$$

where $v_i(x)$ is the velocity, $\mu$ is the viscosity of the fluid, $S_{ij}^{\varepsilon}(x,x_0)$ is the regularized Green's function, and $g_i$ is the force acting on the segment.

The cutoff function as implemented is:

$$\phi_{\varepsilon}(x - x_0) = \frac{15\varepsilon^4}{8\pi(r^2 + \varepsilon^2)^{7/2}} \quad \text{(Equation 2)}$$

The Regularized Stokeslet is:

$$S_{ij}^{\varepsilon}(x, x_0) = \delta_{ij}\frac{r^2 + 2\varepsilon^2}{(r^2 + \varepsilon^2)^{3/2}} + \frac{(x_i - x_{0,i})(x_j - x_{0,j})}{(r^2 + \varepsilon^2)^{3/2}} \quad \text{(Equation 3)}$$

This regularized Green's function $S_{ij}^{\varepsilon}$ only depends on the geometry of the segment and the regularized parameter $\varepsilon$. Therefore, for a given velocity, the force applied to each segment can be calculated accordingly. The forward and lateral forces are derived according to the motion direction. The regularized parameters $\varepsilon$ is chosen as a quarter of the radius of the filament.

Figure 8:
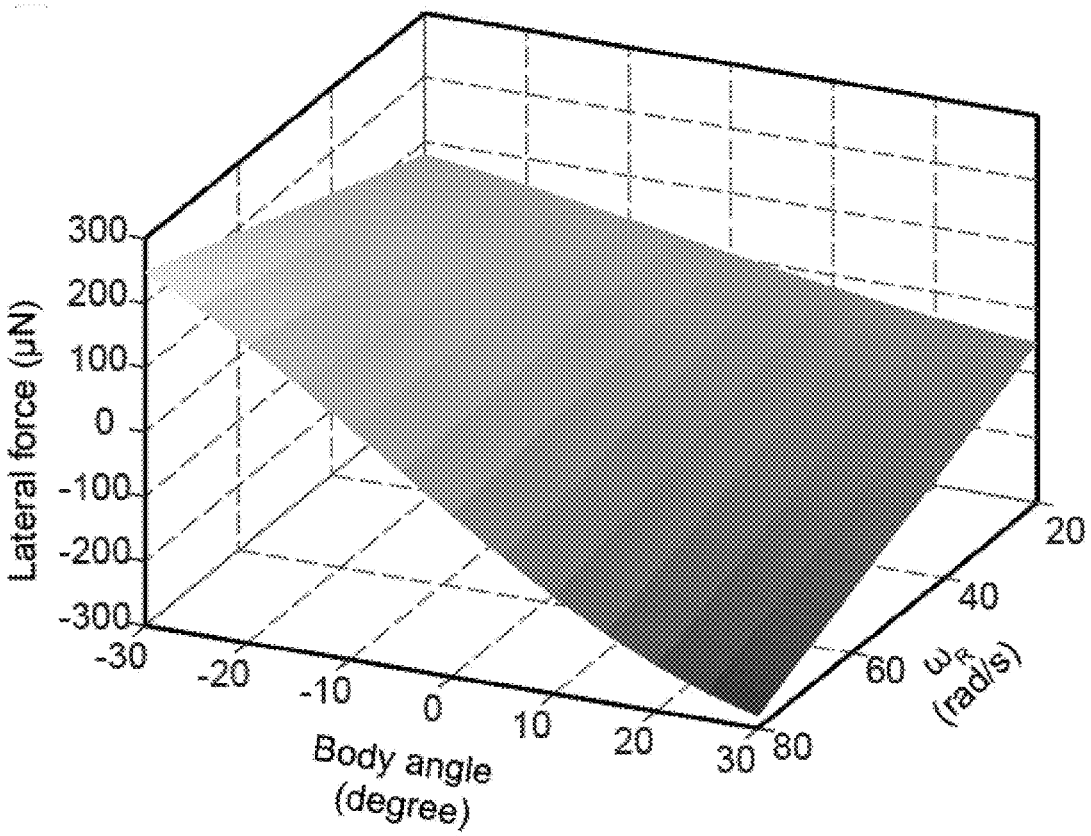
FIG. 8 shows the relationship between the body angle, the rear motor rotational speed, and the lateral force on the ray sperm.

Based on the analysis of the sperm's dynamic model, the relationship between the body angle A, the rear motor rotational speed, and the lateral force on the main body 140 can be determined, as plotted in FIG. 8. When the angle between the main body 140 and the rear-drive mechanism 130 is not zero, the propulsion direction of the front-drive mechanism 110 and the rear-drive mechanism 130 will differ. Part of the propulsion force will be in the lateral direction and is transferred to the lateral force. As the propulsion force is positively correlated with the rotational speed, an increase in the rear motor rotational speed can result in a larger lateral force. As shown in FIG. 8, the lateral force increases along with the body angle A and the rear motor rotational speed. Hence, the lateral force and the turning motion of the underwater vehicle 100 can be controllable by adjusting the rear motor rotational speed and the body angle A. In summary, the front-rear distributed drive mode can realize a highly flexible and easily controllable smooth turning motion, showing superior maneuverability.

Therefore, the underwater vehicle 100 of the present disclosure mimics the movement patterns of a ray sperm and shows superior motion linearity, stability, and turning ability. This combined structure, as described above, possesses high motion linearity and straightness, and slight swing motion. In addition, the underwater vehicle 100 demonstrates the capability of achieving a small turning radius with highly flexible turning ability. This illustrates the fundamental structure for use in a wide spectrum of underwater applications, such as in submarines and torpedoes, or biomedical applications, such as drug delivery. It will be apparent that variants of the above-disclosed and other features and functions, or alternatives thereof, may be combined into many other different methods or apparatuses. The present embodiment is, therefore, to be considered in all respects as illustrative and not restrictive. The scope of the disclosure is indicated by the appended claims rather than by the preceding description, and all changes that come within the meaning and range of equivalency of the claims are therefore intended to be embraced therein.

What is claimed is:

1. An underwater vehicle, comprising:

a main body having a front end and a rear end, wherein the main body defines a longitudinal axis extending from the front end to the rear end of the main body;

a front-drive mechanism connected to the main body to provide a forward propelling force in a direction parallel to the longitudinal axis;

a rear-drive mechanism; and a steering assembly fixed to the rear end and coupled to the rear-drive mechanism, wherein:

the steering assembly is configured to rotate the rear-drive mechanism with respect to the longitudinal axis by a body angle for providing a lateral force on the main body; and the front-drive mechanism comprises four front motors arranged symmetrically with respect to the longitudinal axis.

2. The underwater vehicle of claim 1, wherein the front-drive mechanism comprises a plurality of front motors connected to a periphery of the main body.

3. The underwater vehicle of claim 2, wherein the plurality of front motors are arranged symmetrically with respect to the longitudinal axis.

4. The underwater vehicle of claim 1, wherein the steering assembly comprises a steering engine and a steering arm, wherein the steering arm is pivotable by the steering engine to rotate relative to the longitudinal axis by the body angle.

5. The underwater vehicle of claim 4, wherein the steering engine is a servo motor, a stepper motor, or an electromechanical device, such that the body angle is accurately controlled.

6. The underwater vehicle of claim 4, wherein the rear-drive mechanism is fixedly connected to the steering arm, thereby the rear-drive mechanism provides the lateral force derived according to a motion direction.

7. The underwater vehicle of claim 6, wherein the rear-drive mechanism comprises one or more rear motors arranged to propel along a tail direction defined by the body angle.

8. The underwater vehicle of claim 7, wherein the steering arm is attached to a cuspate fin structure, wherein the cuspate fin structure is a bionic fishtail for balancing and steering the one or more rear motors to propel along the tail direction.

9. The underwater vehicle of claim 6, wherein the rear-drive mechanism comprises two rear motors arranged symmetrically with respect to the steering arm to propel along a tail direction defined by the body angle.

10. The underwater vehicle of claim 1 further comprising a processor configured to dynamically adjust the forward propelling force, the lateral force, and the body angle for performing a variety of linear motions and turning motions.

11. The underwater vehicle of claim 10, wherein the processor is configured to adjust the forward propelling force, the lateral force, and the body angle based on a regularized stokeslet model as defined by:

$$v_i(x) = \frac{1}{8\pi\mu} S_{ij}^{\varepsilon}(x, x_0) g_j;$$

$$\phi_{\varepsilon}(x - x_0) = \frac{15\varepsilon^4}{8\pi(r^2 + \varepsilon^2)^{7/2}}; \text{ and}$$

$$S_{ij}^{\varepsilon}(x, x_0) = \delta_{ij} \frac{r^2 + 2\varepsilon^2}{(r^2 + \varepsilon^2)^{3/2}} + \frac{(x_i - x_{0,i})(x_j - x_{0,j})}{(r^2 + \varepsilon^2)^{3/2}},$$

wherein: $v_i(x)$ is velocity;

$\mu$ is viscosity of the fluid;

$S_{ij}^{\varepsilon}(x, x_0)$ is a regularized Green's function;

$g_i$ is the force acting on the segment;

$r = \|x - x_0\|$; and $\varepsilon$ is a regularized parameter.

12. The underwater vehicle of claim 1, wherein the underwater vehicle is an autonomous underwater vehicle or a remotely operated vehicle.

13. The underwater vehicle of claim 1, wherein the front end comprises a half-spherical shell, and the main body is a hollow cylinder.

14. A torpedo, comprising:

a main body having a front end and a rear end, wherein the main body defines a longitudinal axis extending from the front end to the rear end of the main body;

a processor housed within the main body;

a front-drive mechanism connected to the main body to provide a forward propelling force in a direction parallel to the longitudinal axis;

a rear-drive mechanism;

a steering assembly fixed to the rear end and coupled to the rear-drive mechanism; and a navigation guidance system configured to communicate with and receive signals from object sensors, satellite communication terminals, or both the object sensors and the satellite communication terminals, wherein:

the steering assembly is configured to rotate the rear-drive mechanism with respect to the longitudinal axis by a body angle for providing a lateral force on the main body;

the processor is configured to control the underwater vehicle in response to the navigation guidance system for performing linear motions and turning motions;

the front-drive mechanism comprises four front motors arranged symmetrically with respect to the longitudinal axis;

the steering assembly comprises a steering engine and a steering arm, wherein the steering arm is pivotable by the steering engine to rotate relative to the longitudinal axis by the body angle;

the rear-drive mechanism is fixedly connected to the steering arm, thereby the rear-drive mechanism provides the lateral force derived according to a motion direction; and the rear-drive mechanism comprises two rear motors arranged symmetrically with respect to the steering arm to propel along a tail direction defined by the body angle.

15. An underwater vehicle, comprising:

a main body having a front end and a rear end, wherein the main body defines a longitudinal axis extending from the front end to the rear end of the main body;

a front-drive mechanism connected to the main body to provide a forward propelling force in a direction parallel to the longitudinal axis;

a rear-drive mechanism; and a steering assembly fixed to the rear end and coupled to the rear-drive mechanism, wherein:

the steering assembly is configured to rotate the rear-drive mechanism with respect to the longitudinal axis by a body angle for providing a lateral force on the main body; and the front end comprises a half-spherical shell, and the main body is a hollow cylinder.

16. The underwater vehicle of claim 15, wherein the front-drive mechanism comprises a plurality of front motors connected to a periphery of the main body.

17. The underwater vehicle of claim 16, wherein the plurality of front motors are arranged symmetrically with respect to the longitudinal axis.

18. The underwater vehicle of claim 15, wherein the steering assembly comprises a steering engine and a steering arm, wherein the steering arm is pivotable by the steering engine to rotate relative to the longitudinal axis by the body angle.

19. The underwater vehicle of claim 18, wherein the rear-drive mechanism is fixedly connected to the steering arm, thereby the rear-drive mechanism provides the lateral force derived according to a motion direction; and wherein the rear-drive mechanism comprises two rear motors arranged symmetrically with respect to the steering arm to propel along a tail direction defined by the body angle.

20. The underwater vehicle of claim 15 further comprising a processor configured to dynamically adjust the forward propelling force, the lateral force, and the body angle for performing a variety of linear motions and turning motions, wherein the processor is configured to adjust the forward propelling force, the lateral force, and the body angle based on a regularized stokeslet model as defined by:

$$v_i(x) = \frac{1}{8\pi\mu} S_{ij}^{\varepsilon}(x, x_0) g_j;$$

$$\phi_\varepsilon(x - x_0) = \frac{15\varepsilon^4}{8\pi(r^2 + \varepsilon^2)^{7/2}}; \text{ and}$$

$$S_{ij}^{\varepsilon}(x, x_0) = \delta_{ij} \frac{r^2 + 2\varepsilon^2}{(r^2 + \varepsilon^2)^{3/2}} + \frac{(x_i - x_{0,i})(x_j - x_{0,j})}{(r^2 + \varepsilon^2)^{3/2}},$$

wherein:

$v_i$ (x) is velocity;

μ is viscosity of fluid;

$S_{ij}^{\varepsilon}$ (x, $x_0$) is a regularized Green's function;

$g_i$ is a force acting on a segment;

$r = \|x - x_0\|$; and

ε is a regularized parameter.

* * * * *